United States Patent [19]

Meylan

[11] 3,959,973

[45] June 1, 1976

[54] APPARATUS FOR CONTROLLING STEAM BLOCKING AT STUFFING BOXES FOR STEAM TURBINE SHAFTING

[75] Inventor: Pierre Meylan, Neuenhof, Switzerland

[73] Assignee: BBC Brown Boveri & Company Limited, Baden, Switzerland

[22] Filed: Apr. 16, 1975

[21] Appl. No.: 568,571

[30] Foreign Application Priority Data

May 22, 1974 Switzerland ..... 7037/74

[52] U.S. Cl. ..... 60/657; 60/646; 60/656

[51] Int. Cl.² ..... F01K 13/00

[58] Field of Search ..... 60/646, 656, 657; 277/15

[56] References Cited

UNITED STATES PATENTS

| | | | |
|---|---|---|---|
| 3,062,553 | 11/1962 | Juzi | 60/646 X |
| 3,302,951 | 2/1967 | Olesen | 60/657 |
| 3,604,206 | 9/1971 | Baily | 60/644 |

*Primary Examiner*—Allen M. Ostrager
*Attorney, Agent, or Firm*—Pierce, Scheffler & Parker

[57] ABSTRACT

In a steam turbine structure, a stuffing box is conventionally provided for the rotor shaft at the shaft pass-through opening in the turbine casing and blocking steam is admitted to the stuffing box. In order to prevent thermal-shock damage to the shaft at the stuffing box during a re-start of the turbine while the shaft temperature is still approximately at its normal operating temperature and while the blocking steam is then temporarily in a wet state, the blocking steam is prevented from reaching the stuffing box, the wet steam being diverted by way of a controllable valve through a by-pass leading to a condenser. After the blocking steam has reached its dry state, the valve closes off the by-pass to the condenser and opens the blocking steam line leading to the stuffing box.

8 Claims, 2 Drawing Figures

Figure 1:
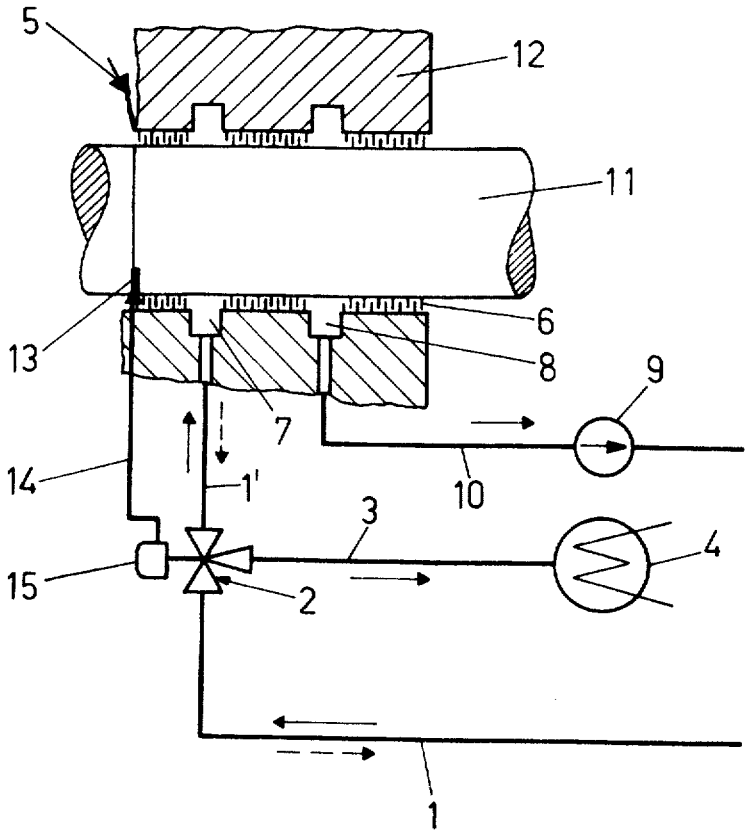

APPARATUS FOR CONTROLLING STEAM BLOCKING AT STUFFING BOXES FOR STEAM TURBINE SHAFTING

The present invention relates to an improved apparatus for controlling flow of blocking steam to the shaft-stuffing boxes of steam-powered machines and especially steam turbines having stuffing boxes provided with a blocking steam input line and a leakage steam outlet line, there being a control valve in the input line and a vacuum pump in the leakage steam outlet line.

When steam-powered machines, especially steam turbines are stopped for short periods of time, the rotor shaft remains at a temperature which is close to the normal operating temperature due to its relatively great thermal inertia. However, the pipes and accessories of the stuffing boxes will cool off rapidly because their heat storing capacity, which is relatively low due to the low-volume masses involved and the preferred light type of construction, leads to a minimum of thermal inertia.

When the machine is re-started, the live steam, or auxiliary, superheated steam, utilized for the blocking function at the stuffing boxes will be cooled off by the pipes and accessories, thus reaching the stuffing boxes in the form of wet steam. This wet steam will there come into contact with the hot shaft at a great difference in temperature with the result that substantial thermal stresses will arise within the surface regions of the shaft. Since the peripheral zone of the shaft is provided with recesses at the stuffing boxes to accommodate the set-in lamella of the labyrinth type shaft seal, there will occur at certain points stress concentrations which exceed the permissible load.

The object of the present invention is to provide an improved arrangement by which these undesirable stresses in the peripheral zones of the shaft can be eliminated and especially so at the stuffing box so that the difference in temperature will have but little influence on the stress distribution in the shaft.

This objective is attained by novel features which are principally characterized by the construction of the valve by which flow of blocking steam to the stuffing box is controlled. More particularly, the control valve is provided, in addition to the inlet and outlets controlling flow of steam through the valve to the stuffing box, with a second outlet which connects with a by-pass leading to a condenser component of the power plant that includes the steam turbine. The two outlets from the valve are controlled conjointly by means of an automatically operated valve member rigidly connected with an elastic bellows which is tightly sealed and partially filled with a fluid e.g. a liquid, whereby the bellows, which is automatically controlled in functional relation to the steam temperature, functions to close off the outlet from the valve to the by-pass and simultaneously open the outlet from the valve to the stuffing box during normal operation of the machine when the steam is hot, and conversely functions to open the valve outlet to the by-pass and simultaneously close the valve outlet to the stuffing box when the steam is in a cold state which is especially so during starting of the machine.

This arrangement prevents wet steam from reaching the stuffing box during the starting period of the machine because the automatically controlled valve will open the outlet leading to the stuffing box only when the blocking steam has attained its dry or superheated state. In this manner there is avoided any thermo-shock at the shaft when the machine is re-started after a temporary shut-down, thus eliminating almost completely the danger of surface cracks.

When the machine is started cold, the blocking steam will be conducted to the stuffing box for the shaft only after the steam has reached its dry state so that the difference in temperature, existing between shaft, stuffing box and blocking steam, will have only a very slight impact. Since the coefficient of heat transfer is substantially lower for dry or superheated steam than for wet steam, the surface of the shaft or of other components are precluded from any sudden heat-up. Since the valve is controlled in functional relation to the steam temperature, the valve will always respond automatically to any state of the blocking steam, thus making unnecessary any remote control or monitoring.

The specific valve used has the advantage that it requires neither actuating nor control devices because the bellows, partially filled with fluid, will expand by the pressure generated during the heating-up phase, and will close the by-pass outlet from the valve and open the outlet to the stuffing box when its expansion has reached a specific predetermined point.

It will be expedient to partially fill the bellows with that amount of water which, at the operating temperature of the steam-powered machine, will definitely be within the superheated range. This offers the advantage that, beginning at a certain temperature, the pressure rise inside the bellows will no longer follow the saturation characteristic, but rather will increase only slightly with each incremental increase in temperature, and will cause the valve to open to the stuffing box only when all moisture has been removed from the blocking steam and from the feeding pipes, and when the effective steam temperature nearly matches the temperature at the surface of the shaft.

Figure 2:
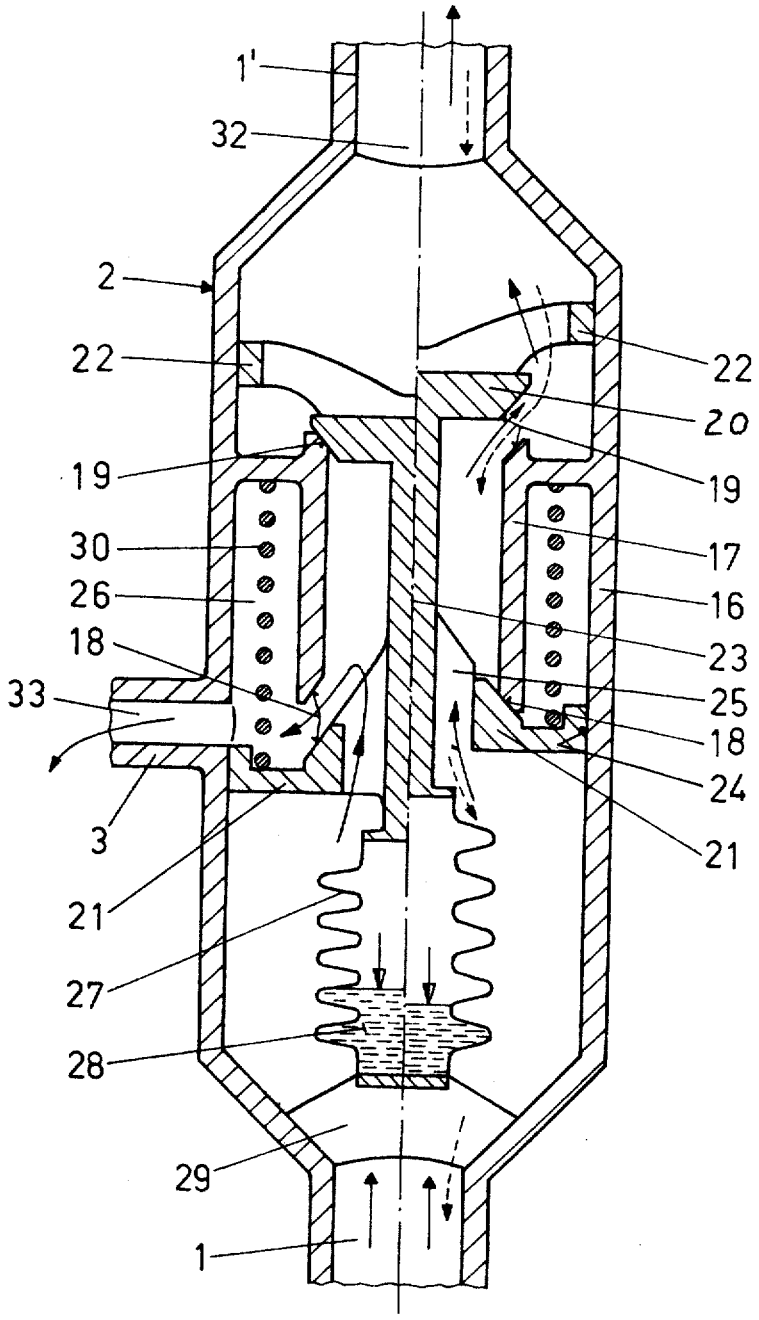

The foregoing as well as other objects and advantages inherent in the improved arrangement of the valve controlling flow of blocking steam to the stuffing box will become more apparent from the following detailed description of a preferred embodiment thereof and from the accompanying drawings wherein:

FIG. 1 is a schematic view of a part of the end wall of the casing of a steam turbine in the vicinity of the stuffing box for the rotor shaft together with the control valve and blocking steam lines; and FIG. 2 is a longitudinal sectional view, drawn to an enlarged scale, of a modified control valve for use in the system of FIG. 1.

With reference now to the drawings and to FIG. 1 in particular, the end wall of the casing of the turbomachine, e.g. a steam turbine is indicated at 12 and is provided with a pass-through opening for the shaft 11 of the turbine rotor. For sealing the shaft pass-through opening against loss of the turbine fluid medium, e.g. steam, a labyrinth type stuffing box structure 5 is provided between the surface of the shaft and the surrounding opening through the casing end wall 12, the seal being formed by a series of interfitting lamella extending respectively from the surfaces of the shaft and wall opening which thereby establish a tortuous type of passage that functions as a barrier to escape of the turbine fluid in an axially outward direction along the shaft through the wall opening.

In order to provide additional protection against loss of the turbine fluid medium through the shaft packing it will be seen that an auxiliary fluid medium is introduced into the stuffing box 5 at a point intermediate the length thereof through an inlet pipe 1, 1' from a suitable source, there being a control valve 2 interposed in the inlet pipe sections 1, 1' and the end of the pipe section 1' being connected to an annular chamber 7 in the wall 12 which surrounds shaft 11. On the assumption that the turbo-machine is a steam turbine, the auxiliary fluid medium which performs a blocking function will either be live steam or auxiliary superheated steam. When valve 2 is in this open mode, the blocking steam flows into the annular chamber 7 as indicated by the solid directional arrow, thence axially to the right as seen in the drawing through the middle portion of the labyrinth seal structure until it reaches a second annular chamber 8 from whence it is withdrawn, together with any admixed air leaking into the labyrinth, through exhaust line 10 which contains a vacuum pump 9.

As previously indicated, when turbo-machines and particularly steam turbines are stopped for short periods of time, the shaft remains at a temperature which is close to the operating temperature of the machine due to its relative great thermal inertia. On the other hand, pipes and accessories of the stuffing box will cool off rather rapidly because their heat storage capacity is relatively much lower than that of the shaft due to their much lower mass volumes and the preferred mechanically light type of construction. When the turbine is re-started, the live or superheated steam, utilized as barrier steam for the stuffing boxes will be cooled off by the pipes and the accessories, thus reaching the stuffing boxes in the form of wet steam. This wet steam will come into contact with the hot shaft at a great difference in temperature. Even though this difference in temperature is in effect for brief periods of time only, five seconds at the most, it will be sufficient to cause substantial thermal stresses to arise within the surface regions of the shaft. Since this portion of the shaft is provided with grooves for receiving the lamella 6, stress concentrations will develop in the shaft material which go beyond the permissible stress or ductibility limits of the material leading to formation of cracks in the shaft. For these reasons, it will be seen that the control valve 2 is provided with an auxiliary outlet line 3 which when opened by-passes any incoming wet steam from line 1 to a condenser 4 of the steam power plant, the outlet from valve 2 to line 1' at such time being closed.

Operation of the valve 2 is accordingly controlled as a function of the operating condition of the steam turbine such that when the latter is in a cold state, and especially during starting, the outlet from the valve to line 1' leading to the stuffing box 5 is closed and the by-pass line 3 for the wet steam is open. After the blocking steam has reached its dry, superheated state, the by-pass line 3 is closed and line 1' leading to the stuffing box 5 is opened. In this manner any thermal shock effect at the shaft is avoided when the turbine is restarted after a temporary shut down.

Upon a conclusion of the starting process, i.e. when the machine is fully operating, the blocking steam will no longer flow into the chamber 7 through the inlet pipe 1', as indicated by the solid line directional arrow, but rather, in accordance with the difference in steam pressure generated, the steam will flow from chamber 7 into and through valve 2 into the input pipe 1, thus reversing the direction of flow, as indicated by the broken line arrows. However, the drain 10 will continue to function as before.

In the embodiment of the invention as depicted in FIG. 1, a drive 15 for actuating valve 2 from one operating mode to the other is provided and this drive can be made to function, for example, by means of a time relay, not illustrated, the relay responding after a specific time delay, for example 5 minutes from the moment or re-start to switch over the valve, so that by-pass line 3 is closed and inlet line 1' opened. Alternatively, the valve drive mechanism 15 can be actuated as a function of the rising temperature in shaft 11 during the starting phase, this being detected by means of a temperature sensing probe 13 located at the shaft and which measures its temperature. Probe 13 is electrically connected to the drive 15 by means of a line 14 which carries the shaft temperature to the control mechanism for the drive 15, the latter then being actuated to close off by-pass line 3 and open inlet line 1' when the shaft has reached a predetermined temperature which itself is taken as a signal that the blocking steam is no longer wet.

In the embodiment of the invention as depicted by FIG. 2, the control valve 2 which corresponds in function to valve 2 of FIG. 1, is so constructed that its operation is made to depend directly upon a comparison between the state of the blocking steam and the state of a reference steam produced within a bellows unit incorporated in the valve actuating structure.

The actuating mechanism for valve 2' is installed within a tubular housing 16 to which is attached a cylindrical valve sleeve 17 which is provided with valve seats 18, 19 respectively at the opposite ends thereof. Mounted for longitudinal reciprocating movement within sleeve 17 is a valve stem 23 which is provided at its opposite ends with valve discs 20 and 21 which cooperate respectively with valve seats 19 and 18. The upper end of the valve stem 23, as viewed in the drawing, is provided with one or more laterally extending arms 22, the outer ends of which slide in contact with the inner surface of housing 16 and hence guide the valve stem in its movement. The lower end of valve stem 23 is secured to one end of a bellows unit 27 which is partially filled with a liquid 28, e.g. water, the opposite end of the bellows unit being secured by means of a web structure 29 to the lower end of casing 16, and the water within the bellows being sealed off steam and pressure proof. The amount of the water or other liquid within the bellows is selected in such manner that at a temperature of approximately 170°, there is attained saturation steam pressure within the bellows, and that the steam within the bellows becomes superheated if the temperature increases still further. Thus when the temperature rises above the point of steam saturation, i.e. is above 170°C, the increase in pressure will be slower than the rise of the saturation characteristic line. This specific arrangement has the advantage that the valve seat 19 can open only when the blocking steam has definitely reached its dry state so that any residual moisture will not cause, within the short input pipe 1' another cooling off, or any increase in moisture, respectively.

The lower valve disk 21 is provided with passages 25 for the blocking steam and the valve seat 18 is located radially beyong the passages 25. When the valve seat 18 is closed off by contact with valve disc 21, as depicted by the right-half of FIG. 2, it closes off the annular area 26 and therefore also the by-pass 3. In this state of the valve, the upper valve disc 20 is of course raised from its seat 19 thus allowing the blocking steam flowing through the passages 25 to reach the input pipe 1'.

When the valve stem 23 is in the other position as depicted in the left half of FIG. 2, the valve seat 19 is closed off by valve disc 20 and the valve seat 18 is open thus directing the flow of blocking steam entering through inlet pipe 1 laterally outward through the by-pass 3.

It is also expedient to load the movable valve assembly, i.e. the valve stem 23 and valve discs 20, 21 by means of a helical spring 30 which can be installed in a simple manner, in the annular space 26 between the support for sleeve 17 at the housing 16, the upper end of this spring being fixed in position by the adjacent wall structure of the housing, and the lower end of the spring bearing against the lower valve disc 21. Thus spring 30 will preload the bellows unit 27 in the cold state and build up a pressure proportional to the initial stressing force.

I claim:

1. In a steam turbine structure wherein a stuffing box is provided for the rotor shaft at the pass-through opening in the turbine casing and blocking steam is admitted to the stuffing box, the improvement where, in order to prevent thermalshock damage to the shaft at the stuffing box during a re-start of the turbine while the shaft temperature is still at approximately its normal operating temperature and while the blocking steam is still in a wet state, means are provided for preventing the wet steam from reaching the stuffing box, said means including a controllable valve in the line of the blocking steam to the stuffing box for by-passing the wet steam to a condenser, said valve means being actuated after the blocking steam has reached its dry state to close off the by-pass to said condenser and open the blocking steam line to the stuffing box.

2. Steam turbine structure as defined in claim 1 wherein said valve means is controlled by a timer.

3. Steam turbine structure as defined in claim 1 wherein said valve means is controlled in accordance with the shaft temperature.

4. Steam turbine structure as defined in claim 1 wherein said valve means is controlled by means which directly monitor the state of the blocking steam.

5. Steam turbine structure as defined in claim 1 wherein said valve means is controlled by means which directly monitor the state of the blocking steam, said steam monitoring means being comprised of an elastic bellows unit which is partially filled with a fluid and which is heated by the blocking steam flowing in heat-exchange relation therewith, said bellows unit being connected to the controllable member of said valve means and which operates the same between two alternative positions which respectively by-pass wet steam through one valve outlet to the condenser and admit dry steam to the stuffing box through a second valve outlet.

6. Steam turbine structure as defined in claim 5 wherein the fluid which partially fills said bellows unit is water, the amount of the water being selected in such manner that superheated steam is formed at the mean operating temperature of the plant of which the steam turbine forms a part whereby the change in volume of the fluid causes said valve means to close off the by-pass outlet to said condenser and open the outlet leading to the stuffing box.

7. Steam turbine structure as defined in claim 5 wherein said controllable valve means includes a valve stem connected to said bellows unit, said valve stem including a valve member at each end thereof cooperative with a valve seat and which is actuated longitudinally of itself by said bellows unit between two alternative positions to close off flow of blocking steam through one of said valve seats to one outlet from the valve and opens up flow of blocking steam through the other valve seat to a second outlet from the valve.

8. Steam turbine structure as defined in claim 7 and wherein said controllable valve means includes a spring coupled to said valve stem for biasing the valve to the position in which the valve outlet to said by-pass is open.

* * * * *